United States Patent [19]

Araki

[11] Patent Number: 4,901,112

[45] Date of Patent: Feb. 13, 1990

[54] COPYING APPARATUS AND METHOD OF DEVELOPMENT CONTROL

[75] Inventor: Kazuhiro Araki, Osaka, Japan

[73] Assignee: Minolta Camera Kabushiki Kaisha, Osaka, Japan

[21] Appl. No.: 288,157

[22] Filed: Dec. 22, 1988

[30] Foreign Application Priority Data

Dec. 23, 1987 [JP] Japan ..... 62-326518

[51] Int. Cl.[4] ..... G03G 15/06

[52] U.S. Cl. ..... 355/245; 355/210; 355/218

[58] Field of Search ..... 355/245, 25, 218, 251, 355/252, 210; 430/120, 122

[56] References Cited

U.S. PATENT DOCUMENTS 3,860,338 1/1975 Reehil ..... 355/218
4,641,952 2/1987 Donohue ..... 355/218 X
4,728,995 3/1988 Matsuda .
4,745,438 5/1988 Acquaviva ..... 355/218 X

FOREIGN PATENT DOCUMENTS 58-57146 4/1983 Japan .
59-228680 12/1984 Japan .

*Primary Examiner*—R. L. Moses
*Attorney, Agent, or Firm*—Burns, Doane, Swecker & Mathis

[57] ABSTRACT

A developing device disposed at a fixed position is controlled so as to suspend its developing operation of supplying toner to an electrostatic latent image for a predetermined period of time when boundary portion of two electrostatic latent images successively formed on the moving surface of a photoconductive drum corresponding to two images of originals passes through the developing section.

5 Claims, 4 Drawing Sheets

COPYING APPARATUS AND METHOD OF DEVELOPMENT CONTROL

BACKGROUND OF THE INVENTION

1. Technical Field of the Invention

The present invention relates to a type of copying apparatus wherein an electrostatic latent image formed on a photoconductive drum is developed by toner and also to a method for controlling development.

2. Brief Description of Related Art

When copying a book or two originals having uneven plane or a joint between pages or originals, there appears a shadow when exposure is made and it causes to produce black lines on an image.

Japanese Published Unexamined Utility Model Application No. 172854/1981 and No. 143632/1978 disclose original illuminating devices capable of solving such problems.

The devices are equipped with a main mirror which directs the light from a light source to one side of exposure portion of an original and a submirror which directs the light from the light source to opposite side of exposure portion of the original for illuminating the exposure portion of the original from both sides so as not to produce any shadow even if there exists uneven plane or a joint between two originals.

It may also be considered to erase a shadow portion which corresponds to a portion of a photoconductive drum by making use of a suberaser provided for erasing a portion other than a regular image since the portion where a shadow appears is known according to the size of each original when two originals are copied simultaneously.

Generally, however, low-cost copying machines are not equipped with such submirror and suberaser since a machine becomes considerably expensive when they are provided. Therefore, when two originals are copied simultaneously with such a low-cost copying machine, a shadow is produced between the originals, and the portion of shadow appears as black lines on an image copied.

SUMMARY OF THE INVENTION

The main object of the present invention is to provide a copying machine and a method for controlling development capable of avoiding the appearance of shadow on an image copied by arranging not to develop a specific portion of an electrostatic latent image formed on a photoconductive drum, and further, without using such specific member and device as submirror and suberaser.

Another object of the present invention is to provide a convenient copying machine which is arranged to be able to select whether a specific portion of an electrostatic latent image formed on a photoconductive drum is to be developed or not.

A further object of the present invention is to provide a copying machine capable of setting an undeveloping specific portion of an electrostatic latent image formed on a photoconductive drum according to the size of an original, and further, capable of corresponding to various sizes of originals.

The other objects and features of the present invention will become more apparent from the following description taken in conjunction with the accompanying drawings.

DESCRIPTION OF THE PREFERRED EMBODIMENTS

An embodiment of the present invention will now be described below with reference to the accompanying drawings.

Figure 1:
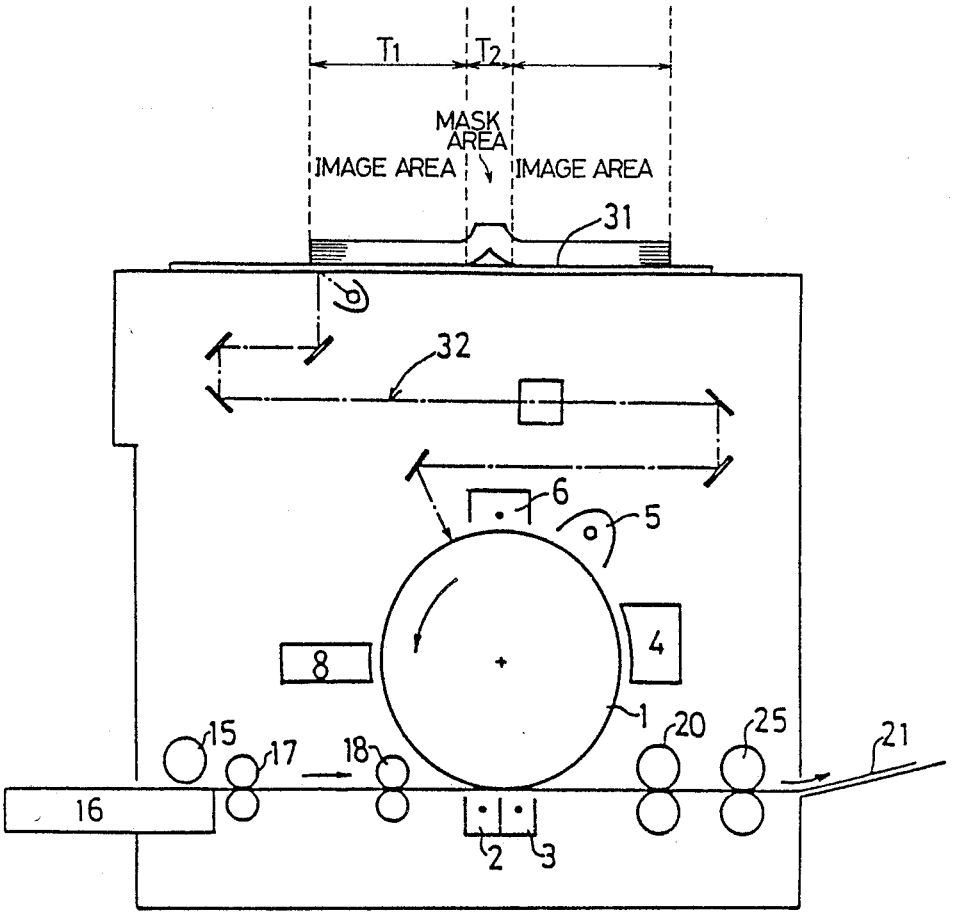
FIG. 1 is a schematic view illustrating the whole structure of a copying machine to which the present invention is applied.

FIG. 1 illustrates an example of a copying machine to which the present invention is applied.

Around a photoconductive drum 1, a cleaning device 4, an eraser lamp 5, a charger 6, a developing unit 8, a transfer charger 2 and a separation charger 3 are sequentially disposed in the direction of rotation of the photoconductive drum 1.

An image of original placed on a glass table 31 is exposed through an optical system 32 to form an electrostatic latent image on the portion electrified by the charger 6 of the photoconductive drum 1. The toner supplied by the developing unit 8 is electrically adsorbed on the electrostatic latent image thereby forming a toner image on the photoconductive drum 1. The toner image is then transferred onto a copy sheet fed thereto simultaneously. After transfer, the copy sheet is separated from the photoconductive drum 1 by the separation charger 3.

A paper feed cassette 16 is equipped on the side of the location where the transfer operation is performed. The copy sheets accommodated in the paper feed cassette 16 are transported to a sheet transport path by a paper feed roller 15 to reach a register roller 18 through an intermediate roller 17. Thereafter, the copy sheet transported from the register roller 18 at a predetermined timing passes through the transfer charger 2 and separation charger 3 while receiving transfer and separation process thereat, and then the toner image is fixed on the sheet when it passes through a fixing roller 20. The copy sheet is, thereafter, guided by a discharge roller 25 and is discharged to a discharge tray 21.

Figure 2:
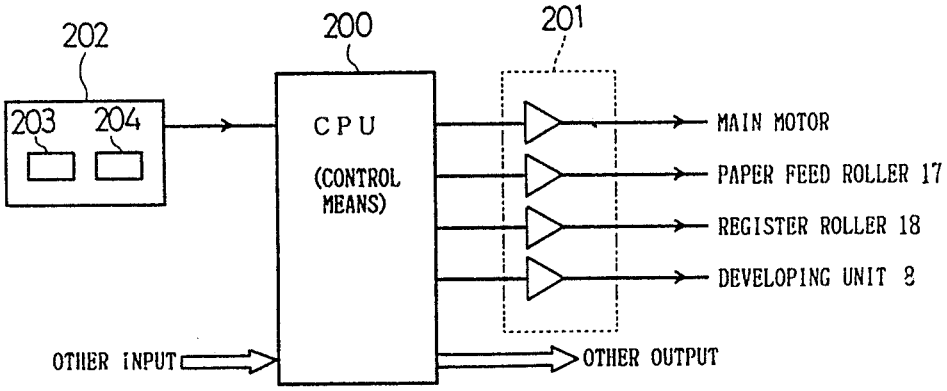
FIG. 2 is a block diagram of a control circuit in an embodiment of the present invention.

FIG. 2 illustrates a control circuit of the copying machine.

One-chip microcomputer is utilized as a CPU 200. From the output port of CPU 200, signals for driving main motor and paper feed roller, signals for controlling the drive of timing roller and for controlling a clutch to drive the developing unit 8 are output to respective driver 201.

To the input port of the CPU 200, signals from mode designating switch 203 on an operation panel 202 are inputted. The mode designating switch 203 is turned on when the documents bound in a book are copied and an operator desires to eliminate a shadow appeared in the central portion, basing on which information is given to the CPU 200 that mask mode is being designated. When the mode designating switch 203 is turned off, information is given to the CPU 200 that the mode is under normal mode. To the input port, information on the size of copy sheet is also inputted from a copy size designating switch 204 on the operation panel 202.

The control procedures of CPU200 will be described in accordance with the flow charts in FIGS. 3 through 5.

Figure 3:
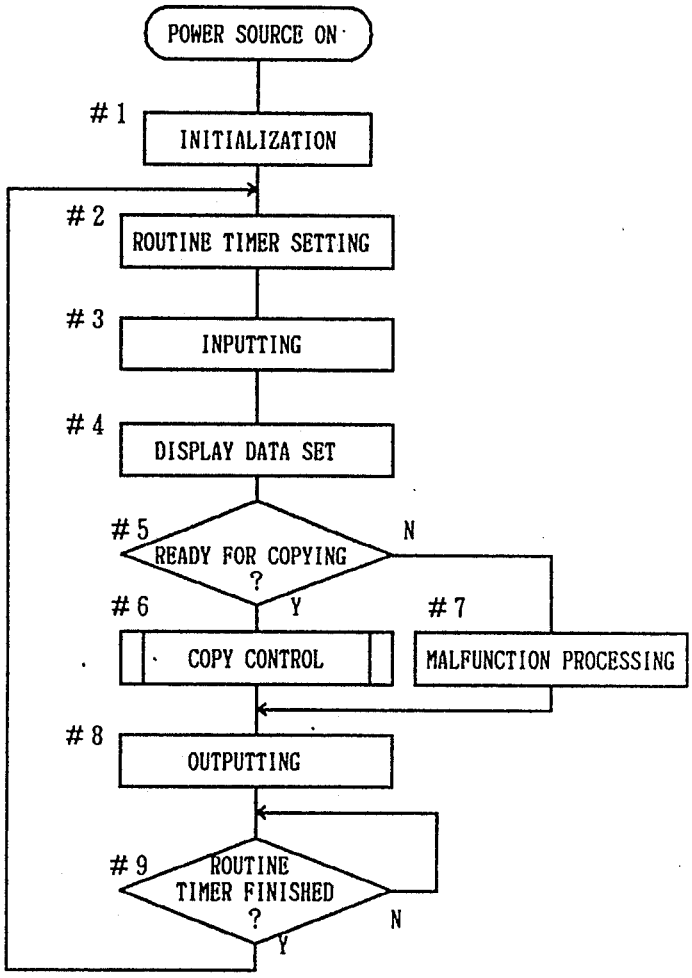
FIG. 3 is a flow chart showing a main routine of control by the control circuit in FIG. 2.

FIG. 3 shows a main routine for controlling a copying machine by the CPU200. Upon turning on the power source, initialization is set at step #1 for clearing RAM built in the CPU200 and for standard copying mode. At step #2, an internal timer of the CPU200 is set, by which the time required for the following control procedures, i.e., the time required for one routine is regulated. At step #3, the switches, sensors and the like provided in the operation panel 202 and also in each section of the copying machine are inputted, and at step #4, the display data related to operation keys are set. Then, at step #5, judgment is made whether copying is ready or not, and if the copying is ready, an ordinary copying control, including a control at waiting state, is done at step #6. If the copying is not ready, malfunction procedure is made at step #7. Thereafter, at step #8, control signal, display signal and the like are output, and finally at step #9, judgment is made whether the time set by the internal timer has been completed. If the time has been completed, the program returns to step #2 for another round of procedure.

Figure 4:
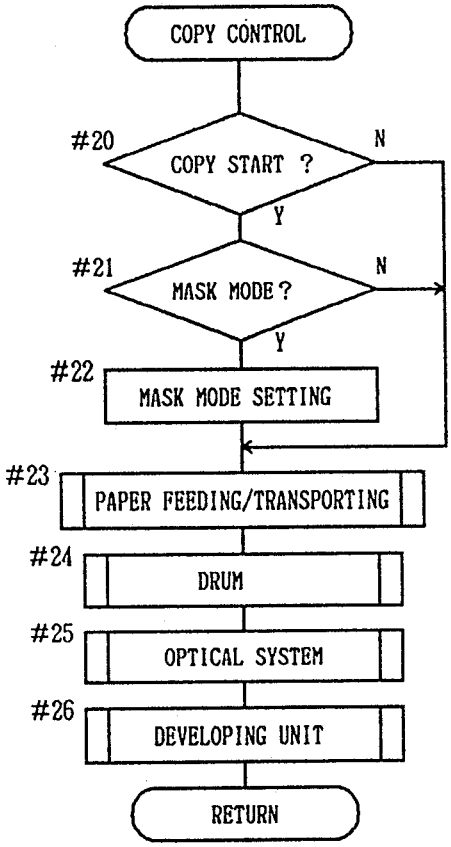
FIG. 4 is a flow chart showing a subroutine for copying control in the main routine in FIG. 3.

The copying control subroutine at step #6 is processed as shown in FIG. 4.

At step #20, judgment is made whether copying has started or not, and when copying is started, judgment is made whether the mode is under mask mode or normal mode at step #21, and the information is given to CPU200 from the designating switch 203. When judgment is made as a mask mode, the program proceeds to step #22 and mask mode is set.

In setting the mask mode, toner replenishment to the photoconductive drum 1 by the developing unit 8 is suspended for a predetermined period of time during a developing process. The time for starting and stopping (refer to $T_1$ and $T_2$ which will be described later) the suspension of toner replenishment is thus set according to copy size information inputted to the CPU200 from the copy size designating switch 204 since it has to be done according to the size of copy sheet.

In this embodiment, it is designed not to replenish toner to a portion which corresponds to the central portion of an image so that black lines do not appear in the central portion of the image when the documents bound in a book are copied.

When the step #22 is finished, when judgment is made at step #20 that copy starting is not ready, and when normal mode is detected at step #21, the program proceeds to step #23 whereat the control for paper feeding and transporting is conducted, and thereafter the control of the photoconductive drum 1 and the devices provided around the photoconducive drum at step #24, the control of optical system 32 at step #25, the control of the developing unit 8 at step #26 are conducted respectively and then returns to the main routine.

Figure 5:
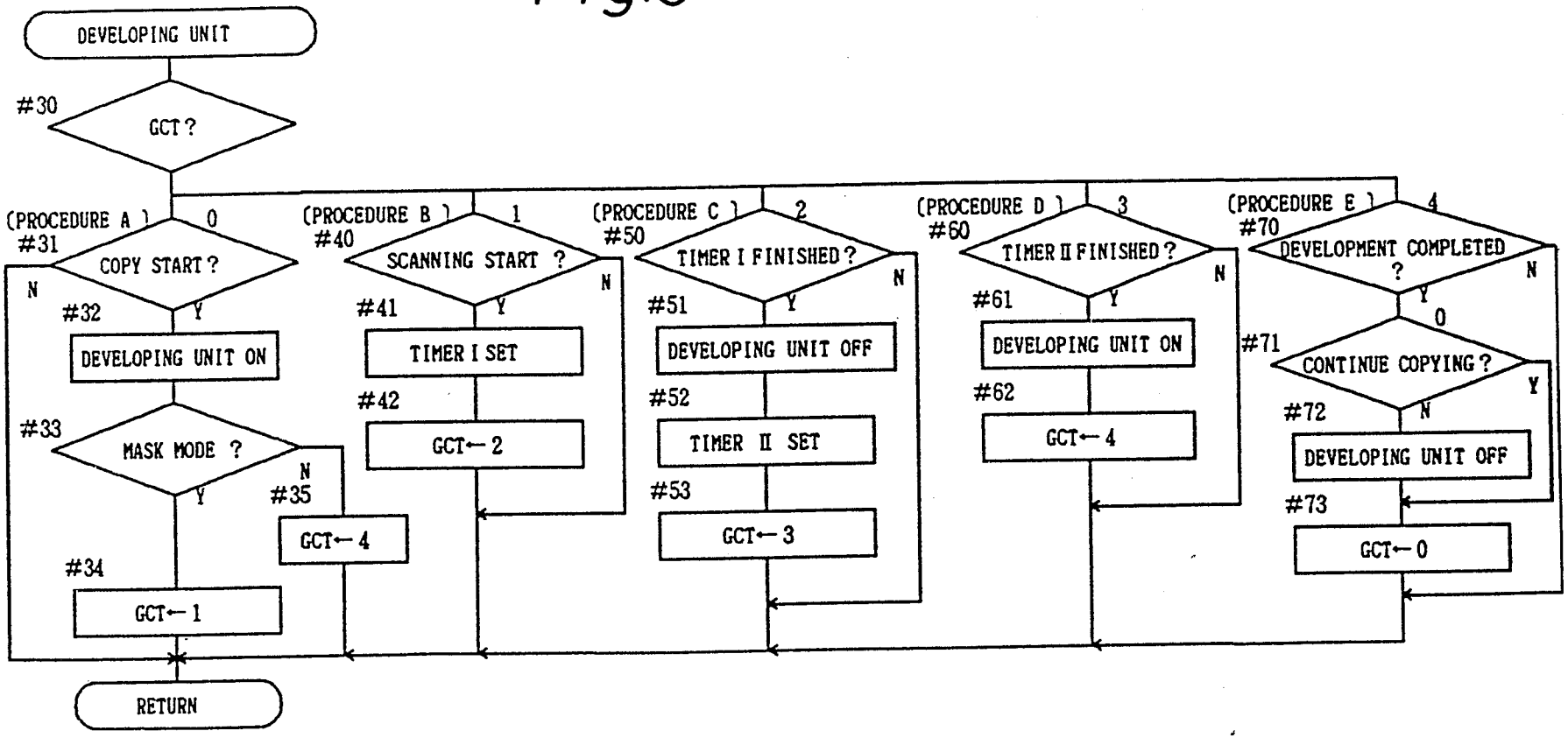
FIG. 5 is a flow chart illustrating a subroutine of a developing unit in the main routine in FIG. 4.

The subroutine of developing unit at step #26 is executed as shown in FIG. 5. The subroutine is provided for controlling the developing unit according to the input from each sensor and the like having a developing unit state counter (GCT) 0–4. The subroutine will now be described below exemplifying the case when mask mode is set for copying the documents bound in a book.

At an initialization, the GCT is set at 0 and procedure A is selected at step #30. At step #31, judgment is made whether copying start is ready or not, i.e., whether a print button has depressed or not, and if the answer is affirmative, the developing unit 8 is turned on at step #32, and then, judgment is made at step #33 whether the mode is under mask mode or not. In this case, the program proceeds to step #34 since mask mode is being designated and returns to the main routine after making the GCT to 1. When judgment is made at step #33 that the mode is not under mask mode (it is under normal mode), the program proceeds to step #35 and returns to the main routine after making the GCT to 4. In other words, when the mode is under mask mode, procedures B through E are performed in the following cycle of operation, and when the mode is under normal mode, procedure E is performed in the next cycle of operation.

At next cycle, procedure B is selected at step #30 since the GCT is made to 1. At step #40, judgment is made whether scanning is ready or not, and when scanning is started, timer I is set at step #41. The set time $T_1$ of the timer I covers the time from start of scanning to the time when the leading edge of masking area (the area whereat toner adhesion is rejected) designated on the photoconductive drum 1 reaches the developing unit 8. The program then returns to the main routine after making the GCT to 2 at step #42.

At next cycle, procedure C is selected at step #30 since the GCT is made to 2. At step #50, judgment is made whether timer I is finished or not, and $T_1$ time after scanning has started, the timer I finishes its operation, then the program proceeds to step #51 to turn off the developing unit 8. Thereafter, timer II is set at step #52. The set time $T_2$ of the timer II covers the time from the time when the leading edge of the masking area reached the developing unit 8 to the time when the rear edge of the masking area passes through the developing unit 8. The time $T_2$ means the time during which toner replenishment from the developing unit 8 is suspended which will be described later. Then, the program returns to the main routine after making the GCT to 3 at step #53.

At next cycle, procedure D is selected at step #30 since the GCT is made to 3. At step #60, judgment is made whether the timer II is finished or not, and the timer II finishes its operation after $T_2$ time elapsed, then the program proceeds to step #61 to turn on the developing unit 8 again and returns to the main routine after making the GCT to 4 at step #62.

At next cycle, procedure E is selected at step #30 since the GCT is made to 4. At step #70, judgment is made whether the developing process is finished or not, and if the developing process is not finished yet, the program returns to the main routine. When the development is finished, judgment is made whether copying operation continues or not. The finish time of development is predetermined according to the size of copy sheet, and when the time is reached the finish time and there is only one copy sheet left, the developing unit 8 is turned off at step #72. Then, the program returns to the main routine after making a the GCT to 0 at step #73. Even if the development is finished, when there are more copies to be made, the program jumps from step #71 to step #73, and returns to the main routine keeping the developing unit 8 ON state.

The ON and OFF states of the developing unit 8 when mask mode is selected thus become as follows.

| | | |
|---|---|---|
| Scanning start<br>Time when leading edge | $T_1$ -Developing Unit 8 | ON |
| of masking area passes<br>Time when rear edge of | $T_2$ -Developing Unit 8 | OFF |
| masking area passes<br>Finish of Development | - Developing Unit 8 | ON |

By turning off the developing unit 8, toner is not replenished to the electrostatic latent image on the masking area of the photoconductive drum 1 and therefore, the image is not visualized thus making the central portion of a copy sheet blank zone. The masking area is set on the portion where the documents bound in a book produce a shadow so that black lines which appear on the image of a copy sheet can be prevented without using submirror, suberaser and the like. When normal mode is being selected, an ordinary copying operation is performed since the procedure D is processed succeeding the procedure A.

The present invention may be embodied in various manners besides the embodiments described above. For instance, in the above embodiments, the information for either normal mode or mask mode is arranged to be given to the control means 200 basing on the judgment of users by utilizing the mode designating switch 203 on the operation panel 202 as information supplying means, however, a switch may be utilized as information supplying means for detecting that an original cover (not shown) used for covering an original glass table 31 is completely closed or not. In this case, when the documents bound in a book is placed on the original glass table 31, the original cover does not close sufficiently and such state is detected by the switch thereby giving information to the control means 200 that the mode is under mask mode, and thus no judgment by users is required.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus, comprising:

an original table capable of placing two originals in a row;

a photoconductive drum having moving photoconductive surface;

an image forming means for forming on the photoconductive drum electrostatic latent images of two originals placed on the original table successively in the direction of movement of the photoconductive surface;

a developing means disposed at a fixed position wherein development is performed by supplying toner to electrostatic latent images on the moving photoconductive surface;

a development control means which is arranged to suspend operation of the developing means for a predetermined period of time when boundary portion of two electrostatic latent images passes through the developing means; and a transfer means for transferring developed two images onto the same sheet of a copy paper.

2. A copying apparatus as defined in claim 1 further comprising a size setting means for setting the size of an original wherein the development control means judges the time when a boundary portion of two electrostatic latent images passes corresponding to the size of an original preset.

3. A copying apparatus as defined in claim 1 further comprising a mode selecting means for selecting either a normal mode or a special mode which is arranged to actuate a development control means and a mode control means for actuating the development control means only when a specific mode is being selected.

4. A copying apparatus, comprising:

an original table capable of placing two originals in a row;

a photoconductive drum having moving photoconductive surface;

a size setting means for setting the size of an original;

a mode selecting means for selecting either a normal mode or a special mode which is arranged to actuate a development control means;

an image forming means for forming on the photoconductive drum electrostatic latent images of two originals placed on the original table successively in the direction of movement of the photoconductive surface;

a developing means disposed at a fixed position wherein development is performed by supplying toner to electrostatic lateant imagaes on the moving photoconductive surface;

a development control means which is arranged to suspend operation of the developing means for a predetermined period of time when boundary portion of two electrostatic latent images passes through the developing means corresponding to the size of an original preset;

a mode control means for actuating the development control means only when a specific mode is being selected; and a transfer means for transferring developed two images onto the same sheet of a copy paper.

5. In a copying apparatus comprising an original table capable of placing two originals in a row, a photoconductive drum having moving photoconductive surface, an electrostatic latent image forming means for forming on the photoconductive drum electrostatic latent images of two originals placed on the original table successively in the direction of movement of the photoconductive surface, a developing means disposed at a fixed position wherein development is performed by supplying toner to electrostatic latent images on the moving photoconductive surface, and a development control means which controls the operation of the development control means;

the method for controlling development comprising the steps of:

initiating the operation of the developing means when copying operation is started;

suspending the operation of the developing means for a predetermined period of time when boundary portion of two electrostatic latent images passes through the developing means; and initiating the operation of the developing means again after the predetermined period of time has elapsed, thus developing the portion other than the boundary portion of two electrostatic latent images on the photoconductive drum.

* * * * *